US008002001B2

(12) United States Patent
Leshem

(10) Patent No.: US 8,002,001 B2
(45) Date of Patent: Aug. 23, 2011

(54) REFILLING DEVICE AND METHOD OF FILLING

(76) Inventor: Adoram Leshem, Tel Aviv (IL)

( * ) Notice: Subject to any disclaimer, the term of this patent is extended or adjusted under 35 U.S.C. 154(b) by 935 days.

(21) Appl. No.: 11/948,556

(22) Filed: Nov. 30, 2007

(65) Prior Publication Data

US 2008/0066825 A1 Mar. 20, 2008

Related U.S. Application Data

(63) Continuation-in-part of application No. PCT/IL2006/000645, filed on Jun. 4, 2006.

(30) Foreign Application Priority Data

Jun. 3, 2005 (IL) ..... 168994

(51) Int. Cl.
*B65B 1/04* (2006.01)

(52) U.S. Cl. ..... 141/319; 141/3; 141/20; 141/113; 141/338

(58) Field of Classification Search ..... 141/3, 18, 141/20, 319, 113, 338; 222/402.12, 402.13, 222/567
See application file for complete search history.

(56) References Cited

U.S. PATENT DOCUMENTS

| | | | | |
|---|---|---|---|---|
| 2,985,382 | A * | 5/1961 | Coplan | 239/288.5 |
| 3,116,856 | A * | 1/1964 | Prussin et al. | 222/402.24 |
| 3,186,645 | A * | 6/1965 | Eberlein | 239/567 |
| 3,559,701 | A * | 2/1971 | Wittersheim et al. | 141/20 |
| 3,620,266 | A * | 11/1971 | Ryder | 141/20 |
| 3,680,605 | A * | 8/1972 | Nigro | 141/20 |
| 3,841,533 | A * | 10/1974 | Carroll et al. | 222/402.13 |
| 3,936,000 | A * | 2/1976 | Weyn | 239/288.5 |
| 4,836,253 | A * | 6/1989 | Nye | 141/18 |
| 5,524,680 | A | 6/1996 | de Laforcade | |
| 7,431,222 | B2 * | 10/2008 | Monterrosa | 239/288.5 |
| 7,686,190 | B2 * | 3/2010 | Patrick | 222/153.11 |
| 2005/0056343 | A1 | 3/2005 | Gueret | |

FOREIGN PATENT DOCUMENTS

| | | |
|---|---|---|
| GB | 2229380 | 9/1990 |
| WO | 02052977 | 7/2002 |

OTHER PUBLICATIONS

International Search Report and Written Opinion from International Application No. PCT/IL2006/000645 filed Jun. 4, 2006.

* cited by examiner

*Primary Examiner* — Timothy L Maust
(74) *Attorney, Agent, or Firm* — Seth H. Ostrow; Ostrow Kaufman LLP

(57) ABSTRACT

A product dispenser refillable from a donor container via a spray nozzle comprising a hollow body for receiving and storing said product, a dispensing mechanism for dispensing said product, an open aperture through which product is filled into said body, capping means to cap the open aperture after filling the container to prevent leakage of product from said opening, characterized in that the dispenser comprises a filling interface arrangement integrally coupled to said open aperture that guides the spray from the spray nozzle of the donor container directly into the open aperture of the dispenser.

18 Claims, 7 Drawing Sheets

REFILLING DEVICE AND METHOD OF FILLING

CLAIM OF PRIORITY

This application is a continuation in part of International Patent Application Serial No. PCT/IL2006/000645, filed on Jun. 4, 2006, which claims priority under 35 U.S.C. §119(a)-(d) or 35 U.S.C. §365(b) of IL application number IL168994, filed Jun. 3, 2005.

BACKGROUND OF INVENTION

1. Field of Invention

The present invention relates to refillable devices, in particular for carrying and dispensing products such as cosmetics or care products.

2. Discussion of Related Art

It is frequently convenient to have the option to carry a small container of a product, e.g. cosmetics such as perfumes, lotions, etc., for example when one is out for the evening or traveling. However, not all products are sold in conveniently small sized containers, and, if so they are typically more expensive and need be repurchased at more frequent intervals.

For addressing this issue, small-sized refillable containers for carrying and dispensing such products are known. For example, Patent Application No. GB2229380, to Winterflood, discloses a perfume atomizer with a cap and body in the form of a pen that can be refilled from a larger donor bottle of perfume. The atomizer can be refilled by pouring—or in the case of an aerosol or spray/atomizer type donor container, the donor container's spray nozzle is removed and the exposed stub of the donor pump is inserted into one end of the atomizer and filled via pumping action wherein the atomizer is held and repeatedly pushed down on the donor container or the donor container is held and repeatedly pushed into the atomizer.

Another example of a refillable packaging for dispensing a product from a donor container is described in U.S. Patent Application Publication No. 2005/056343, to Gueret. The packaging includes a filling valve designed to fit on top of the dispenser member of the donor container, after the donor container's spray nozzle is removed to expose the nozzle's stub, wherein the packaging sits above the donor container and is filled by holding the packaging and repeatedly pushing down on the donor container, or repeatedly pushing the donor container into the packaging.

U.S. Pat. Nos. 3,559,701; 3,680,605 and 5,524,680 disclose refillable dispensing devices. These devices are all refilled by a tube from the donor container penetrating through an aperture in the device, the opening of the aperture being controlled by some kind of valve. The same hold true for UK Patent No. GB 2229380.

WO 02/052977 discloses a pocket size refillable atomizer bottle. The bottle is substantially flat shaped and has a substantially large (at least 14 mm by 20 mm) refill opening in the front or back of the bottle for refilling with a spray from a master bottle.

The size and shape of the refill opening is large enough to ensure that all of the perfume is confined within the limits of the refill opening. A cover is provided to prevent losing the filled contents of the device.

SUMMARY OF INVENTION

In one aspect, the present invention relates to a device for containing and dispensing a product, the device being adapted to be fillable from a donor container and comprising: a hollow body for receiving and storing said product, and having an opening where through product is fillable into said body; a dispensing mechanism for dispensing said product; and an interface arrangement for facilitating interfacing between said refillable device and said donor container. The interface arrangement enables the filling opening in the device to have flexible dimensions, thus not being limited to a substantially large opening.

The term "dispensing mechanism" is used in its broadest sense and can include mechanisms as simple as a pour opening or dispensing via squeezing of the device, by a roll-on type mechanism as well as spray mechanisms, pump mechanisms and so on.

The interface arrangement may include an attachment element that can remain part of the refillable device after the device is filled. Alternatively, the attachment element can be designed so as not to be integral with the refillable device after it is filled. In the latter case, the attachment element can be conveniently used to fill a number of devices (e.g. wherein each device contains a different perfume, lotion, gel, powder, air freshener, etc.).

Thus, a refillable device for carrying relatively small amounts of contents that can be conveniently refilled from a donor container is provided. It is important to note that the present device, and its interface arrangement (and attachment element, if any) is preferably designed for proper interfacing with donor containers having dispensers, e.g. spray nozzles, of various sizes and shapes.

For helping to facilitate filling from different spray nozzles, according to particular embodiments of the present device, the fill opening of the device is located in front of the donor container's nozzle at a position slightly spaced apart therefrom, by use of a particularly designed interface arrangement, in which case there is no need for complete compatibility between the shape of the device's fill opening and the donor container's spray nozzle.

In these and other embodiments, the positioning of the device relative to the nozzle during filling may be aided by an urging tendency of the attachment element such as by a flexible piece, a spring, a resilient attachment and the like for urging the opening into contact with the donor bottle's nozzle, or into position in front of and slightly spaced apart from the nozzle's spray aperture. This also facilitates the desirable characteristic of allowing filling of the device from nozzles of different sizes and shapes.

In addition, there is no need to remove the donor container's nozzle in order to fill the device. Furthermore, in most embodiments, the device can be filled from spray bottle type donor containers using essentially the same one-handed, one-finger spray technique used as when dispensing product from the donor container during its normal dispensing.

In another aspect, the present invention relates to a method of filling a device, with a product from a donor bottle having a spray nozzle with a dispensing aperture, the device comprising a fill opening, said method comprising: locating the fill opening of said device opposite said donor container; applying pressure to said nozzle, directly or indirectly, in a manner similar to that used to dispense said product from said donor container.

It is a particular feature of the present device and method that the longitudinal axes of the device and the nozzle are non-parallel during filling, more particularly those axes are at an angle to each other and more particularly those axes are essentially perpendicular to each other. It is a another particular feature of the present device and method that locating the fill opening of the device can be either locating it to a contacting position with the donor container nozzle or a distance slightly spaced apart therefrom.

BRIEF DESCRIPTION OF DRAWINGS

The invention may be more clearly understood upon reading of the following detailed description of non-limiting exemplary embodiments thereof, with reference to the following drawings, in which.

DETAILED DESCRIPTION

Figure 1:
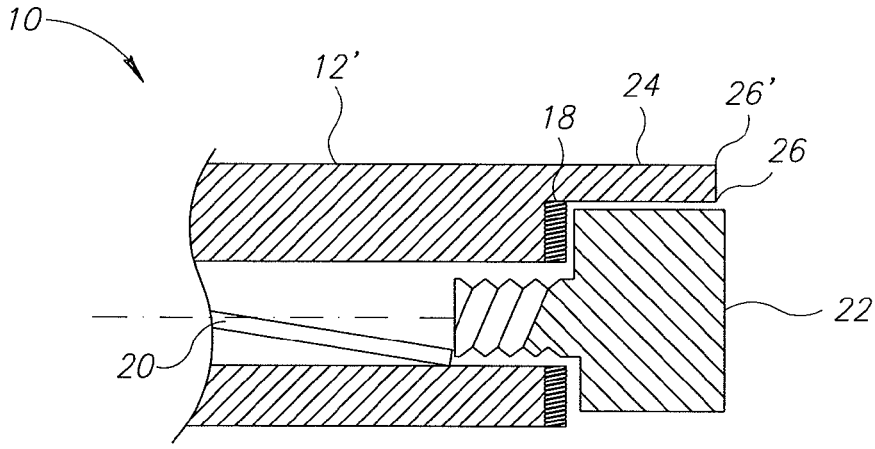
FIG. 1 is a partial side sectional view of an embodiment of the device of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Figure 2:
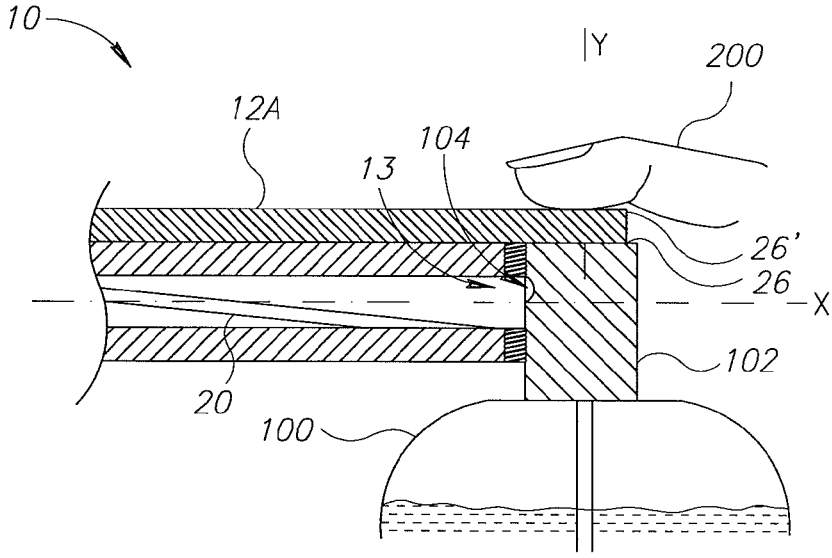
FIG. 2 is a partial side sectional view of the device of FIG. 1 in a refilling position.
Figure 3:
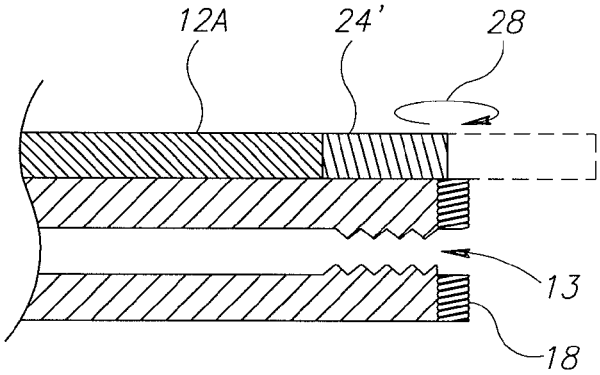
FIG. 3 is a partial side sectional view of an alternative device similar to that of FIG. 1.

FIGS. 1-3 illustrate an embodiment of the present invention, wherein a device 10 has a body 12 which further includes a projection 24 at the filling end thereof, designed to ease filling of the device 10. The design, is particularly suited for filling from donor bottles 100 (FIG. 2) having spray nozzles 102. This is true for many of the embodiments and will thus not be repeated. Thus, after aligning the spray aperture 104 with the opening 13, the device 10 can be easily filled via pressing with one finger 200.

Here, the projection 24 together with the gasket 18 constitute an interface arrangement for interfacing between the device 10 and the donor container 100 while the device is being filled.

The projection 24 may comprise a friction or gripping portion 26 (for example, made of a material as in gasket 18 as illustrated in FIGS. 1 and 2, for reducing the possibility of slippage between the projection and the spray nozzle 102. Likewise, the projection 24 may include a friction or gripping portion 26' for reducing the possibility of slippage between the projection 24 and a finger 200 (or hand, or the like) of a person filling the device 10.

Thus, as seen best in FIG. 2, the device 10 may be conveniently filled with product using a finger or hand position and a pumping or spraying action essentially equivalent to that used for dispensing the product directly from the donor container 100. And, only one hand is required during such filling.

The projection could be retractable or swivel about—the latter illustrated in FIG. 3 by a projection 24' of a body 12*a*, in order to preserve a sleek or narrow profile, comfortable and convenient for carrying in one's hand, pocket or other location. It should be understood that any swiveling movement could be in any of a variety of angles, typically parallel or perpendicular to the body 12*a*, the extended position of the projection 24' shown by a dashed line.

Figure 4:
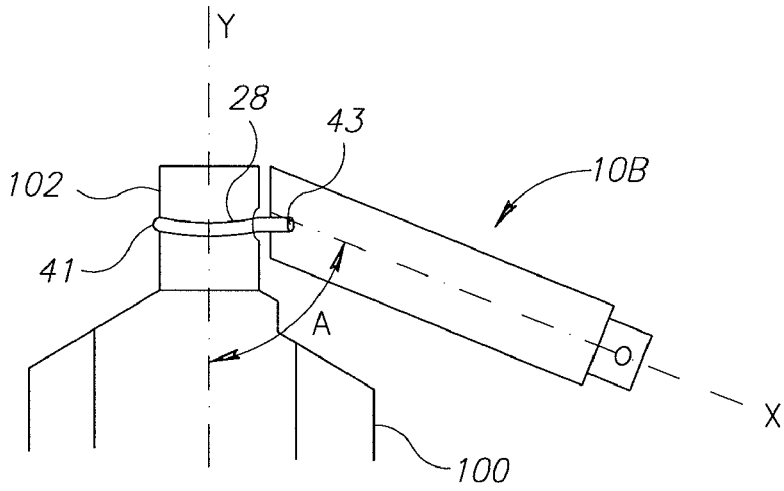
FIG. 4 is a side view of another embodiment of the invention.

In FIG. 4 there is shown one of a variety of design options falling within the scope of the device of the present invention, having an attachment element; in this case an attachment element 28. The attachment element 28 comprises a resilient strap 41 fixed to the body of a device 10*b* at a fix point 43. During filling of the device 10*b*, the strap 41 is stretched around the nozzle 102 of the donor container 100 and thus the spray aperture 104 is held in alignment with the opening 13 (not seen in this view) of the device.

In the pre- or post-fill position, the strap 41 can return to a "rest" position, preferably in somewhat tight contact with the body of the device 10*b*. The strap 41 could be designed to seal the product in the device 10*b* after filling—for which purpose it would preferably be wider than shown in FIG. 4 and possibly further comprise a suitable sealing component (not shown)—or, in the case of a device comprising the sealing arrangement with cap or the like (not shown), the strap would wrap around a cap (not shown). It should be understood that the strap 41 could further comprise a member or portion to facilitate gripping it to allow it to be manually manipulated.

FIG. 4 also illustrates a possible further modification of the device of the present invention, wherein the surface of the filling end of the device 10*b* is angled with respect to its axis X. Thus, there is formed an angle A between the axis X of the device 10*b* and axis Y of the nozzle 102 being less than 90 degrees. Such a configuration may help prevent leakage of product when the device 10*b* and the donor container 100 are detached one from the other after filling.

Thus, it is again seen that the device according to the present invention (device 10*b* in this case) may be conveniently filled with product using a finger/hand position and a pumping or spraying action essentially equivalent to that used for dispensing the product directly from the donor container 100—and only one hand is required during such filling.

Figure 5:
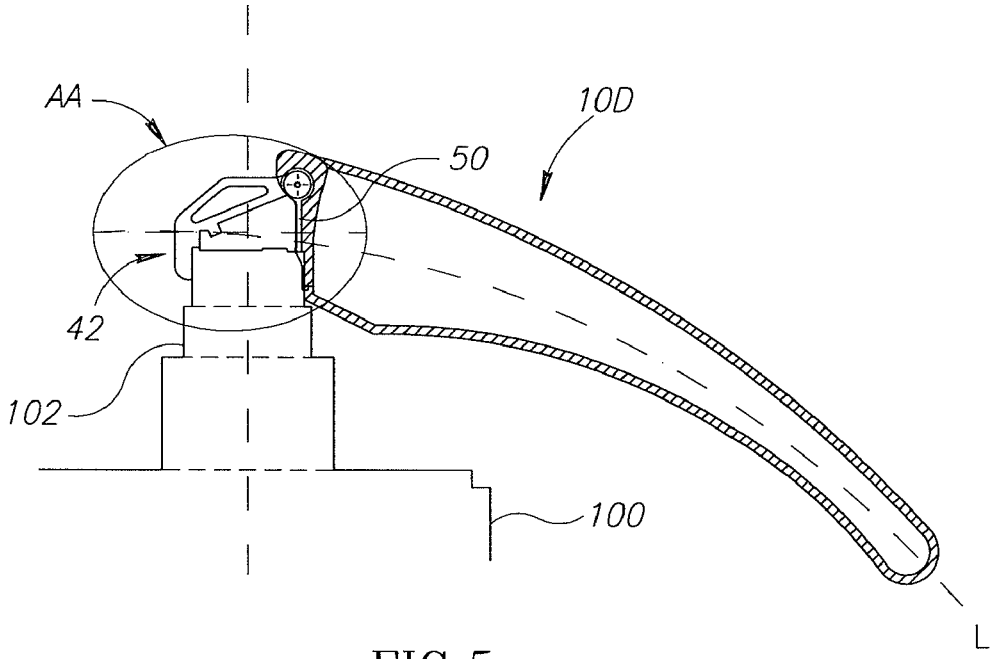
FIG. 5 is a side sectional view of another embodiment of a device of the present invention.
Figure 6:
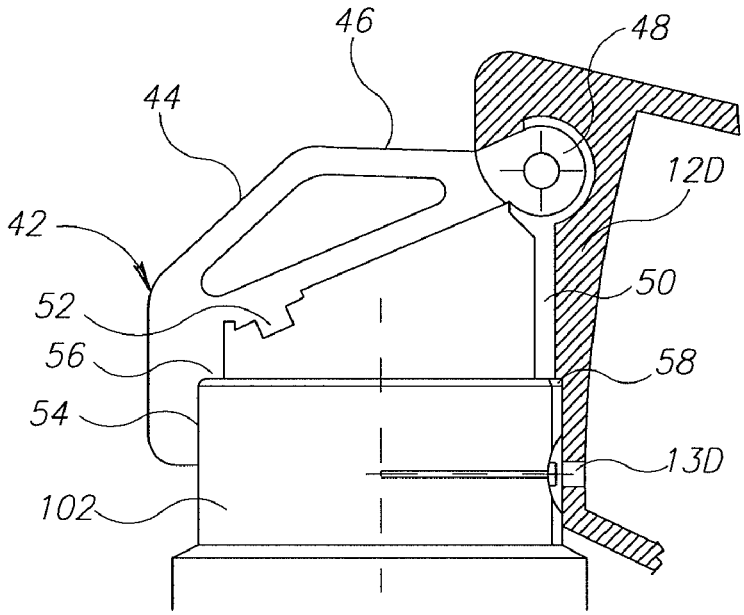
FIG. 6 is an enlarged partial side sectional view of area "AA" of FIG. 5.
Figure 7:
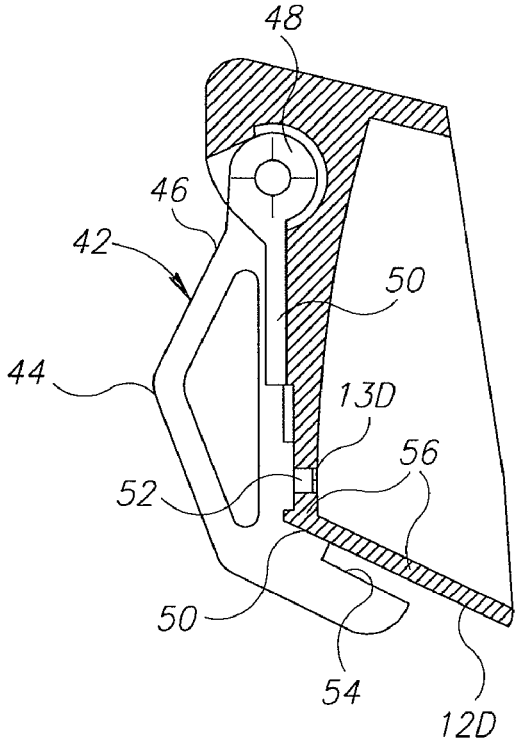
FIG. 7 is a partial side sectional view of the device as in FIG. 6, in a pre- or post-filling position.

FIGS. 5-7 show an example of another attachment element 42 for a device 10*d* in accordance with the present invention of which FIGS. 6 and 7 show enlarged views of portion AA of FIG. 5 in the filling position and pre- or post-filling position (closed position, FIG. 6), respectively.

The attachment element 42 comprises a gripping portion 44 which can be gripped to move the element from a closed position to a filling position. The gripping portion 44 includes a portion 46 which is adapted to be generally horizontal when the device 10*d* is in the filling position and may provide a convenient surface for a user's finger to press against for pumping the spray nozzle 102 of the donor container 100 in order to fill a body 12*d* (shown in the shape of an aesthetically shaped elongated handle) of the device 10*d* with product.

For moving between the open and closed positions, the attachment element 42 pivots about pivot 48 and is urged in the closed position by a spring 50—for helping ensure a secure fit on the nozzle 102 during filling and helping ensure that the product does not leak out of the device 10*d* in the closed position after filling.

Also helping to ensure that product does not leak is a protruding portion 52 of the attachment element 42 which is configured and disposed to correspond to an opening 13*d* of the device 10*d*. To further ensure a proper attachment to the nozzle 102 during filling, the attachment member 42 is typically designed with surfaces 54 and 56, and the body 12*d* comprises surface 58. The surfaces, particularly surfaces 54 and 58 are typically concave with a radius of curvature corresponding to the nozzle 102.

As mentioned, in the filling position the portion 46 is generally horizontal and thus a user's finger can conveniently press thereon for filling the device 10*d* with product; again, the action being essentially equivalent to that used for dispensing the product directly from the donor container 100—and only one hand is required during such filling.

Alternatively, the handle-shaped body 12*d* may be used to press down on the nozzle 102—possibly adapted for use as a lever. As shown, the device 10*d* is designed such that for dispensing product therefrom, the attachment member 42 is moved from the closed position to the open position (as when filling) and product is poured from the device. The devices of examples 1-7 may further comprise a spray-type dispenser such as the dispensing mechanism 14 of FIG. 10.

It will be noticed that the handle-shaped body 12*d* is elongated; having a center line L, shown by a dashed line, indicating a general axis therethrough. The body 12*d* may be arched or curved as shown in FIG. 5, or in any of a variety of configurations and it is noticed again that the center line L is at an angle to the axis Y of the nozzle 102. In particular, the line L approaches an angle of 90 degrees to the axis Y at the location where the device 12*d* and the nozzle 102 interface.

Figure 8:
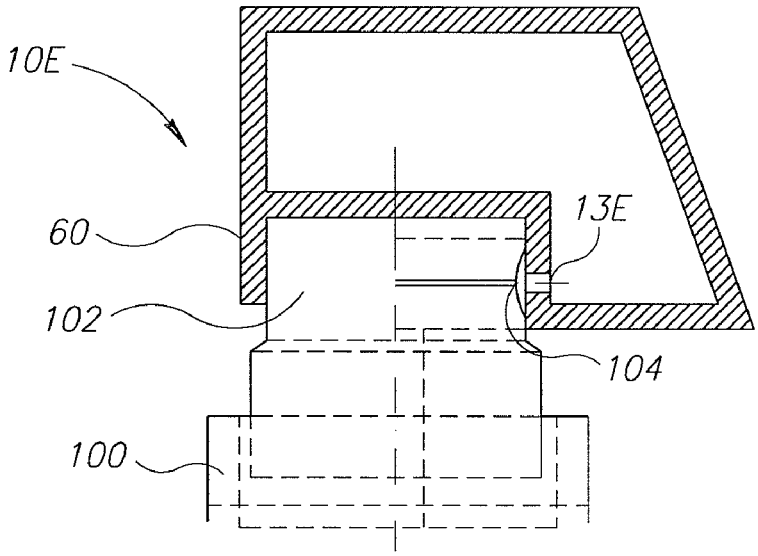
FIG. 8 is a side sectional view of another embodiment of a device of the present invention.
Figure 9:
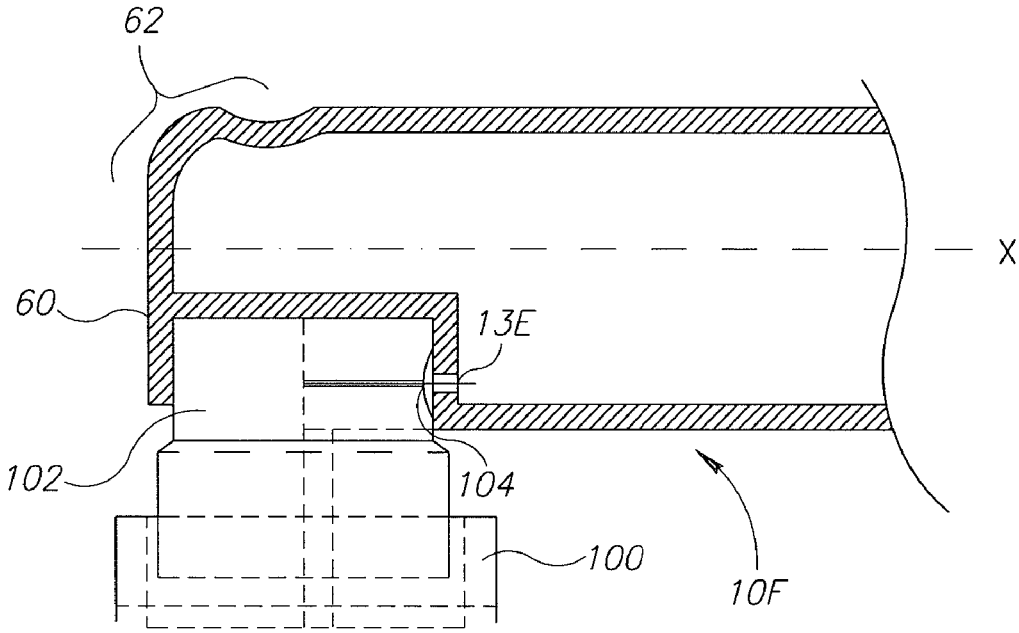
FIG. 9 is a side sectional view of a modification of the device of FIG. 8.

FIGS. 8-9 show a further embodiment of the present invention wherein there are devices 10*e* and 10*f* adapted to interface the nozzle 102 of the donor container 100 and the devices 10*e* and 10*f*. Interface element 60, which constitutes an attachment element, fits over the nozzle 102 and is dimensioned to provide a relatively snug fit and to facilitate alignment of the opening 13*e*, with the spray aperture 104; and it can be understood from the embodiments exemplified in FIGS. 8 and 9 that for such alignment, the devices are most conveniently perpendicular (FIG. 8) or parallel (FIG. 9) to the spray direction from the nozzle 102—this being the main difference between these two devices.

It should be noticed that the devices 10*e* and 10*f* each have a body 12*f* with narrow profiles whereby the devices are conveniently carried and, again it is seen that the devices may be conveniently filled with product using a finger/hand position and a pumping or spraying action in an essentially similar manner to that used for dispensing the product directly from the donor container 100—and only one hand is required during such filling. For exemplary purposes, the device 10*f* is shown having a portion 62 ergonomically designed for a finger to press thereon.

Figure 10:
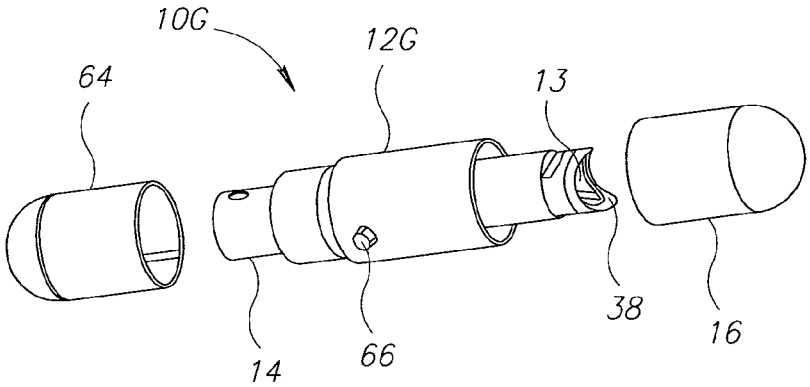
FIG. 10 is a side sectional view of another embodiment of the device of the present invention.

FIG. 10 illustrates another embodiment of the present invention wherein there is a device 10*g* comprising a hollow body 12*g* and a cap or sealing arrangement 16. The device 10*g* has an opening 13 through which product is introduced into the device 10*g* via a spray nozzle of a donor container (not shown) and an interface arrangement 38 surrounding the opening 13 that fits against the spray nozzle of the donor container enabling spraying directly into the opening without losing any product while spraying. The device 10*g* may also comprise a dispensing cover or top 64. The sealing arrangement 16 and top 64 can be attached to the body 12*g* via a variety of means such as a screw connection; a snap-fit connection; pressure fit connection; and the like.

The device 10*g* may further comprise a decorative mark 66, for aesthetic purposes as well as providing a means to help remind the user which perfume, lotion, etc, that the device contains—for which purpose the device may comprise decorative marks of different color, shape, etc—or even provide a surface on which the user can write a mark corresponding to the contents.

Figure 11:
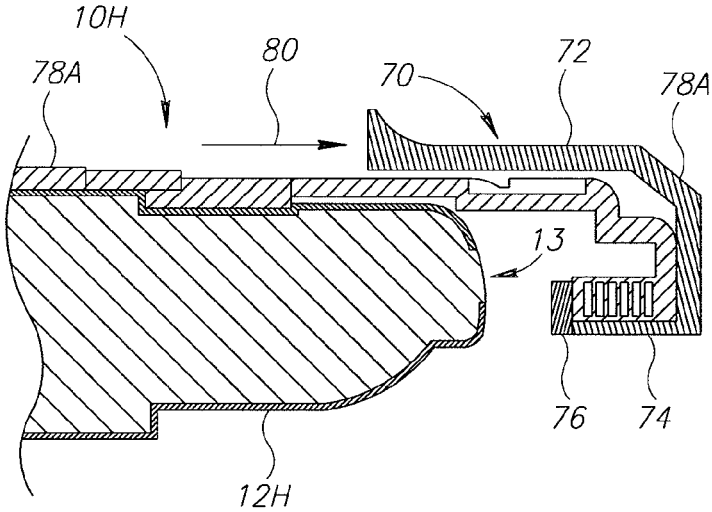
FIGS. 11-13 illustrate additional embodiments of the device of the present invention, in particular illustrating various interface arrangements to aid filling that are detachable from the device.
Figure 12:
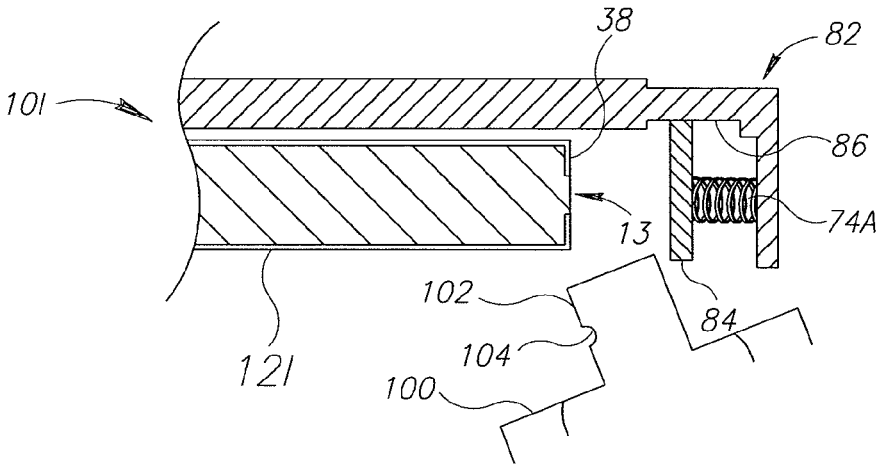
Figure 13:
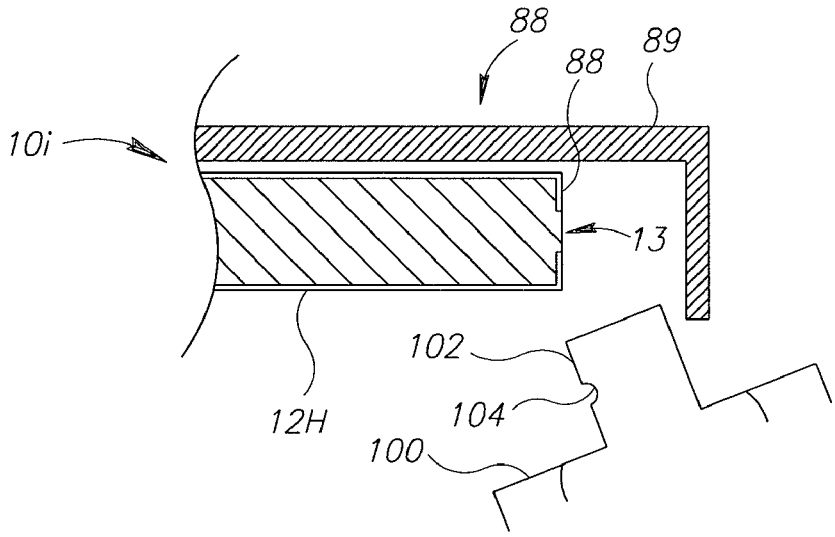

FIG. 11-13 illustrate further embodiments of the present invention, which include interface arrangements that can be detached from the device.

FIG. 11 illustrates a device 10*h* (partially shown) comprising a hollow body 12*h* and having a modified interface arrangement 70. This interface arrangement 70 comprises a connector member 72 attached to the device 10*h* and further comprises a spring 74 and a gripping member 76 to secure the device 10*h* in place relative to a donor container's nozzle during filling. The connector member 72 comprises two components, 78*a* and 78*b*, designed such that component 78*a* can slide over component 78*b*. The connector member 72 may be designed to be permanently attached to the device 10*h* or may be designed such that it is removable/detachable therefrom.

To fill the device 10*h*, the user pushes the connector member 72 in the direction of arrow 80 thereby compressing the spring 74 and providing space for the entrance of the spray nozzle 102 of a donor container 100 (see FIG. 12). The connector member 72 is then released whereby the nozzle 102 is held next to the device 10*h* for convenient filling thereof. It should be noticed that the afore-described design allows the device 10*h* to easily contact and be filled by donor containers 100 having nozzles 102 of various diameters and sizes.

As in most of the described embodiments, this filling can be conveniently performed using one finger pressing of the top surface of the interface arrangement above the nozzle 102—in a manner essentially the same as used when normally dispensing product from the donor container 100.

FIG. 12 illustrates a device 10*i* (partially shown) comprising a hollow body 12*i* and having another variation of an interface arrangement 82. The interface arrangement 82 comprises an urging member 84 which can travel forward and back in track 86 and is urged by a spring 74*a*.

To fill the device 10*i*, the nozzle 102 of the donor container 100 is pushed into a space defined by the interface arrangement 82, its urging member 84 and the surface 38, as seen in FIG. 12 This pushes the urging member 84 back compressing spring 74*a*; and thus the donor container 100 is held by the interface arrangement 82 to facilitate filling of the body 12*i* through opening 13.

FIG. 13 illustrates yet another variation of a device 10*j* having a modified interface arrangement 88 wherein the arrangement comprises an L-shaped portion 89. The L-shaped portion 88 is made of flexibly resilient material. Thus, in a manner similar to described above with respect to FIG. 12, the nozzle 102 can be pushed into a position for filling the device 10*j* and the L-shaped portion acts as a leaf-spring or urging member to hold the nozzle in the proper position.

Figure 14:
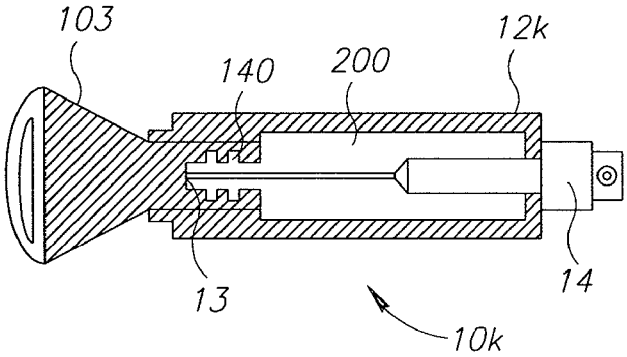
FIGS. 14-16 illustrate a further embodiment of the invention.
Figure 15:
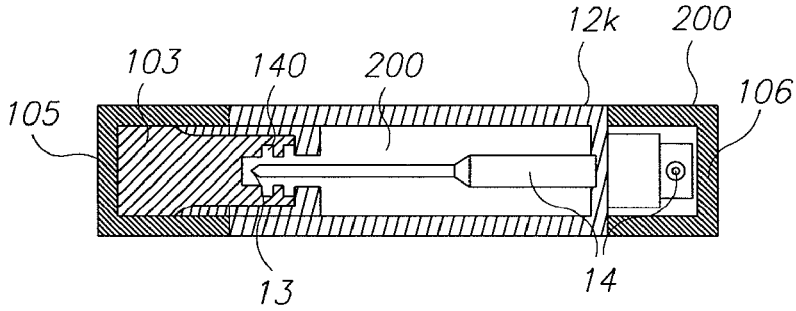
Figure 16:
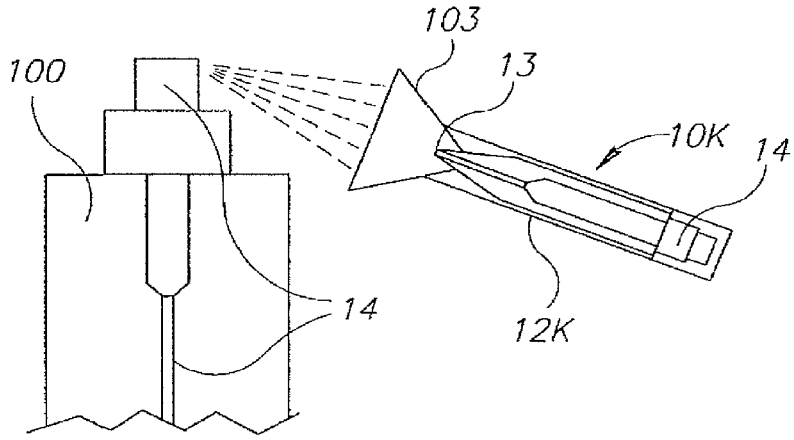

Referring to FIGS. 14-16, there is shown a refillable device 10*k* of the present invention for containing and dispensing a product (e.g. cosmetic, care product and the like filled via a donor container as shown in FIG. 16). The device 10*k* includes a hollow body 12*k*, optionally an internal container 200, an interface arrangement 103, a dispensing mechanism 14, a cap or sealing arrangement 105 over the interface arrangement (FIG. 15) and a top cover 106 for the dispensing mechanism 14. The interface arrangement 103 is in the shape of a funnel and is foldable as shown in FIG. 15. The cap 105 and top cover 106 could be, for example, a screw type mechanism or a click/snap mechanism, or any other sealing and locking method. The hollow body 12*k* and/or internal container 200 could be made of a variety of materials including glass, metal such as aluminum, rigid or soft (squeezable) plastic, silicone etc. The hollow body 12*k* or internal container 200 has a filling opening 13 at one end and may be constructed to hold the interfacing arrangement (example, the funnel 103) as by means of a spline section 140. FIG. 16 shows that the interface arrangement (in the form of a funnel 103) directs and concentrates the spray from the donor container 100 directly into the opening 13 of the device 10K without dispersing around it.

Figure 17:
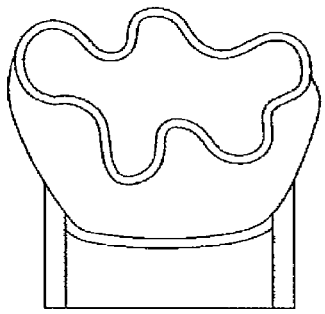
FIGS. 17-18 exemplify some of the different funnel shaped interface arrangements in accordance with the invention.
Figure 18:
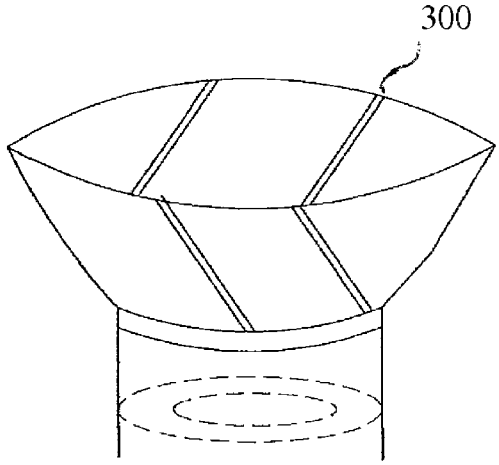

FIGS. 17-18 illustrate two possible variations of interface arrangements in the shape of funnels. In FIG. 17 the funnel is made of flexible material such as silicone and is easily squeezed together or folded so that it can be enclosed within a cap (not shown). In FIG. 18 the funnel may be of more rigid sections 300 that flare out and fold like a fan.

Thus, a refillable device for carrying relatively small amounts of contents that can be refilled from donor containers has been described; the device comprising or adapted for refilling using an interface arrangement. Importantly, the device and interface arrangement are adapted to facilitate refilling from donor containers that may have nozzles of various sizes.

It should be understood that many of the features described herein with respect to a particular embodiment are interchangeable or usable in combination with other embodiments.

It should also be understood that the device of the present invention could be designed in a number of shapes. The shapes could correspond to particular products, for example, so that a user would always refill perfume into a cylindrical device, suntan lotion into a device with a rectangular profile, moisturizer in a tapered tube shaped device, etc. Further or alternatively, the device could be made of a clear material whereby the type and amount of product remaining could be identified. In addition, the device could include a portion or strip designed to allowing convenient writing thereon for product identification.

Further the device could include a ring or other attachment member to allow attachment of the device to a key ring, bracelet, necklace, and the like, for convenient carrying. Also, it could include many other modifications including comprising or being a component in a number of other goods commonly carried, for example, a flashlight, a cigarette lighter, lipstick case, and so on.

In addition, the present invention provides for a combination of or system including any of the above-described devices, or those defined in the below claims, and appropriate donor containers.

The present invention has herein been described with reference to particular embodiments, however, it is to be understood that these are merely exemplary of the principles and applications thereof. Thus, numerous embodiments and modifications may be devised without departing from the scope of the present invention.

What is claimed is:

1. A product dispenser refillable from a spray nozzle of a donor container, said product dispenser comprising:

a hollow body for receiving and storing said product, a spray nozzle at a first end of said hollow body for dispensing said product;

an open aperture at a second end of said hollow body through which product is filled into said body;

capping means to cap the open aperture after filling the container to prevent leakage of product from said opening;

characterized in that the dispenser comprises: a filling interface arrangement integrally coupled at said second end to said open aperture, the filling interface arrangement having at least one flexible wall extending outward from and in communication with the open aperture such that the at least one flexible wall guides the spray from the spray nozzle of the donor container directly into the open aperture of the dispenser.

2. A dispenser according to claim 1, wherein the interface arrangement comprises a gripping member for gripping the spray nozzle of the donor container.

3. A dispenser according to claim 1, wherein the interface arrangement encompasses partially or completely the spray nozzle of the donor container.

4. A dispenser according to claim 1, wherein the interface arrangement is comprised of resilient material.

5. A dispenser according to claim 1, wherein the product dispenser is refillable from a product container via a spray nozzle with only one hand.

6. A dispenser according to claim 1, wherein the capping means encloses the interface arrangement when not filling the dispenser.

7. A dispenser according to claim 1, having an elongated tubular shape.

8. A dispenser according to claim 1, wherein the at least one flexible wall of the filling interface arrangement forms a tubular body extending outward from and in communication with the open aperture such that the tubular body guides the spray directed into an opening in a second end of the tubular body from the spray nozzle of the donor container directly into the open aperture of the dispenser.

9. A dispenser according to claim 8, wherein the tubular body has a funnel shape.

10. A dispenser according to claim 8, wherein the opening at the second end of the tubular body has a perimeter with at least one notch therein for the filling interface arrangement to fit against a curved spray nozzle of the donor container.

11. A dispenser according to claim 8, wherein the tubular body of the interface arrangement is made from a flexible material.

12. A method of filling a product dispenser having a hollow body, a spray nozzle at a first end of said hollow body, a filling opening and a filling interface arrangement at a second end of the hollow body, from a donor container having a spray nozzle, the method comprising:

receiving product sprayed from the donor container via the spray nozzle into the filling interface arrangement of the filling opening of the product dispenser, characterized in that the interface arrangement is coupled at a first end to said opening and has at least one flexible wall extending outward from and is in communication with the opening; and guiding the spray from the spray nozzle directly into the opening with the at least one flexible wall of the filling interface arrangement.

13. A method as in claim 12, wherein the interface arrangement engages the spray nozzle of the donor container enabling transfer of product from the donor container to the product dispenser with only one hand.

14. A method as in claim 12, wherein the product dispenser can be filled via a spray nozzle of a donor container with one hand.

15. A product dispenser refillable from a donor container via a spray nozzle, said product dispenser comprising:

a hollow body for receiving and storing said product, a spray nozzle at a first end of said hollow body for dispensing said product;

an open aperture at a second end of said hollow body through which product is filled into said body; and a filling interface arrangement integrally coupled at a first end to said open aperture, the filling interface arrangement having a tubular body extending outward from and in communication with the open aperture such that the tubular body guides spray directed into an opening in a second end of the tubular body from the spray nozzle of the donor container directly into the open aperture of the dispenser; wherein the opening at the second end of the tubular body has a perimeter with at least one notch therein for the filling interface arrangement to fit against a curved spray nozzle of the donor container.

16. A dispenser according to claim 15, wherein the tubular body has a funnel shape.

17. A dispenser according to claim 15, wherein the tubular body of the interface arrangement is made from a flexible material.

18. A dispenser according to claim 15, wherein the dispenser has tubular hollow body.

* * * * *